US011574527B1

(12) United States Patent
Berry et al.

(10) Patent No.: US 11,574,527 B1
(45) Date of Patent: Feb. 7, 2023

(54) NETWORK GAME SYSTEM AND METHOD

(71) Applicant: ADMITSPLIT, LLC, Banner Elk, NC (US)

(72) Inventors: Brent Berry, Banner Elk, NC (US); Roland Garceau, Banner Elk, NC (US)

(73) Assignee: ADMITSPLIT, LLC, Banner Elk, NC (US)

( * ) Notice: Subject to any disclaimer, the term of this patent is extended or adjusted under 35 U.S.C. 154(b) by 100 days.

(21) Appl. No.: 16/745,478

(22) Filed: Jan. 17, 2020

Related U.S. Application Data

(60) Provisional application No. 62/794,100, filed on Jan. 18, 2019.

(51) Int. Cl.
*G07F 17/32* (2006.01)

(52) U.S. Cl.
CPC ..... *G07F 17/329* (2013.01); *G07F 17/3223* (2013.01); *G07F 17/3272* (2013.01)

(58) Field of Classification Search
CPC . G07F 17/329; G07F 17/3233; G07F 17/3272
See application file for complete search history.

(56) References Cited

U.S. PATENT DOCUMENTS

2002/0037767 A1* 3/2002 Ebin ..... G07F 17/32 463/25
2005/0107152 A1* 5/2005 McGee ..... G07F 17/32 463/17
2010/0203943 A1* 8/2010 Hughes ..... G07F 17/329 463/17

* cited by examiner

*Primary Examiner* — Werner G Garner
(74) *Attorney, Agent, or Firm* — MacCord Mason PLLC

(57) ABSTRACT

Secure transaction processes, assemblies, systems, and methods for conducting an administered gaming raffle are shown and described. In one embodiment, a user entrant enters a particular event, a tangible ticket value is generated and delivered to the user entrant, an administrator management module transforms a plurality of the participant ticket value recognition transactions into a dynamic inventory, which is ultimately streamlined into a winner selection benefiting the user entrant and a predetermined charity or the like.

10 Claims, 18 Drawing Sheets

NETWORK GAME SYSTEM AND METHOD

This application claims the benefit of U.S. provisional application No. 62/794,100, filed Jan. 18, 2019, which is incorporated herein by reference in its entirety.

FIELD OF THE TECHNOLOGY

The present disclosure relates generally to raffle gaming, and more particularly to improved multiplayer organization, monitoring, and administration of reliable game systems and methods.

BACKGROUND

It is desirable to provide rapid, effective gaming in a wide variety of environments and across multi-site platforms. Classical methods of raffle games present geographical limitations for expanding and maximizing outcomes. Several online gaming systems have been developed to expand gaming to non-site-specific advantages.

However these traditional methods and devices limit multiplayer capabilities and multi-site interaction. Further, conventional approaches limit administrator management control and often lead to limited play and less compelling results, principally when targeted to benefit a charity and the like. Particularly, in the educational booster and the like environment, where margins are very cost-sensitive, early and accurate application is desired. In addition, reducing human error is desired, for instance where users might be positioned across multiples sites and may not be technology-trained users. Devices and systems used must, therefore, be user-friendly, secure, and inexpensive without sacrificing accuracy.

Therefore, Applicants desire systems and methods for managing and monitoring gaming development without the drawbacks presented by the traditional systems and methods.

SUMMARY

In accordance with the present disclosure, gaming platforms and modules are provided to administer and monitor raffle gaming development. This disclosure provides improved methods and devices that are convenient, efficient, and safe for the user, particularly when used to manage and operate concurrent multiplayer gaming experiences where players from multiple locations compete with one another.

In one embodiment, conducting a secure automated transaction includes transmitting at least one local event identifier from an administrator management system; obtaining a user entrant information selected from the group consisting of a local event identifier selection; an entrant financial transaction contribution, and an entrant identification verification; generating a tangible ticket value and delivering the tangible ticket value to the user entrant; comparing, by a processor, the user entrant information with administrator management and developing a participant ticket value recognition; and transforming a plurality of participant ticket value recognition transactions into a first inventory and selecting a winner selection from the first inventory.

In certain examples, generating a tangible ticket value includes indexing a monetized value per transaction. The method may include tracking the monetized value transactions. Further, the method may include verifying authenticity of a mobile entrant identity. In addition, the method may include discarding an improper user entrant transaction, for instance a determination of a failed payment transaction, a denied payment transaction, and an insufficient funds transaction.

In particular examples, the method may include generating a tangible ticket value follows receiving an acceptance confirmation. The method may include generating a tangible ticket value follows receiving a purchase agreement confirmation. Further; the method may include confirming available funds to fund at least one unpaid winner selection. In addition, the method may include validating a net transaction determination consisting essentially of verifying an administrator validation input, generating a net transaction display, and generating a net transaction log.

In yet another embodiment, a multiplayer donation raffle system includes a network providing data communication to a plurality of mobile entrant user components independent of a physical geographical location; and an administrator generator in data communication with the network and monitoring a first-level provider authorization access, wherein an authorization access enables input to the mobile entrant users for generating raffle transaction selections and creating events adapted to control at least in part the execution of a live-hosted donation raffle system.

In a further embodiment, in a multiplayer game over at least one communications network, a system having an administrator server adapted to administer a secure automated raffle transaction; and a remote processor housed in a remote event location and in data communication with the administrator server and adapted to enable input to a plurality of entrant consumers administering at least in part the execution of the multi player game over the communications network.

In particular examples, the remote processor includes a remote monitoring module. The remote monitoring module may include a monitoring script. The remote processor may include a remote entry point. The administrator server may be adapted to access the remote processor entry point. The remote processor entry point may include a web browser entry point. The remote processor entry point may include a privilege verification selection.

In certain examples, the system includes a multi-tiered administration access. The multi-tiered administration access may include a full administrator privilege selection. The multi-tiered administration access may include a limited administrator privilege selection comprising limited administer privileges. The limited administrator privilege selection may include a remote log-in privilege. The limited administrator privilege selection may include a local remote administrator privilege. Further, the local remote administrator may include a principal machine-level privilege.

In another embodiment of the disclosure, in a multiplayer game over at least one communications network, a system having a web-responsive administrator production server adapted to administer a secure automated raffle transaction; and a remote access portal in data communication with the administrator production server.

In certain examples, the web-responsive administrator production server includes a privileged static P address. The remote access portal may include a remote monitoring module. The remote monitoring module may include a monitoring script. The remote access portal may include a privilege verification selection.

In particular examples, the system includes a multi-tiered administration access. The multi-tiered administration access may include a full administrator privilege selection. The multi-tiered administration access may include a limited administrator privilege selection comprising limited administer privileges. The limited administrator privilege selection may include a remote log-in privilege. The limited administrator privilege selection may include a local remote administrator privilege. Further, the local remote administrator may include a principal machine-level privilege.

In another embodiment of the disclosure, in a multiplayer game over at least one communications network, a system having a web-responsive remote production server adapted to administer a secure automated raffle transaction; and a remote access portal in data communication with the remote production server.

In certain examples, the web-responsive remote production server includes a privileged static IP address. The remote access portal may include a remote monitoring module. The remote monitoring module may include a monitoring script. The remote access portal may include a privilege verification selection.

In particular examples, the system includes a multi-tiered administration access. The multi-tiered administration access may include a full administrator privilege selection. The multi-tiered administration access may include a limited administrator privilege selection comprising limited administer privileges. The limited administrator privilege selection may include a remote log-in privilege. The limited administrator privilege selection may include a local remote administrator privilege. Further, the local remote administrator may include a principal machine-level privilege.

In one embodiment of the disclosure, a method of conducting a secure automated transaction includes transmitting at least one local event identifier from an administrator management system; obtaining a mobile entrant information selected from the group consisting of a local event identifier selection, an entrant financial transaction contribution; and an entrant identification verification; generating a tangible ticket value and delivering the tangible ticket value to the mobile entrant; comparing, by a processor, the mobile entrant information with administrator management for developing a participant ticket value recognition; and transforming a plurality of participant ticket value recognition transactions into a first inventory and selecting a winner selection from the first inventory.

In some examples, generating a tangible ticket value includes indexing a monetized value per transaction. The method may include tracking the monetized value transactions. The method may include interacting with at least one merchant account corresponding to the mobile entrant, for instance interacting with at least one merchant account includes receiving authorized financial approval from a third party payment center. The method may include verifying authenticity of the mobile entrant identity. The method may include discarding an improper mobile entrant transaction, for instance a determination selected from the group consisting of a failed payment transaction, a denied payment transaction, an insufficient funds transaction, and the like.

In certain examples, generating a tangible ticket value follows receiving an acceptance confirmation. The method may include generating a tangible ticket value follows receiving a purchase agreement confirmation. The method may include delivering the tangible ticket value includes serving a revocation caveat disclaimer, for instance, serving the revocation caveat disclaimer includes generating a determination display selected from the group consisting of a failed payment transaction, a denied payment transaction, an insufficient funds transaction, and the like.

In particular examples, the method includes generating a random winning code and transmitting the winning code to a local administrator communication device. The method may include selecting a winner selection includes developing an array of the first inventory. The method may include transforming the array of first inventory with at least one module operator and generating the random winner selection.

In particular examples, the method includes establishing a request for querying a winner selection. The method may include isolating at least one expired raffle. The method may include isolating at least one unpaid winner selection. The method may include confirming available funds to fund the at least one unpaid winner selection. The method may include validating a net transaction determination. The method may include verifying an administrator validation input. The method may include generating a net transaction display. The method may include generating a net transaction log. The method may include validating the winner selection determination. The method may include verifying an administrator validation input. The method may include generating a winner selection display. The method may include generating a winner selection log. The method may include issuing a payment check corresponding to the winner selection. The method may include linking the check to a winner selection account. The method may include issuing a tax statement report. The method may include delivering a full donation option selection to the winning participant.

In another embodiment of the disclosure, a raffle transaction administrator method implemented on an administrator server for raffle management over a communications network, the administrator method comprising communicating from an administrator interface to a plurality of mobile entrant users, the administrator interface enabling the plurality of entrant users to participate in at least one raffle transaction associated at a local event.

In certain examples, the method includes connecting to a remote monitoring module on the administrator server. The method may include accessing a remote server. The method may include identifying at least one transaction inconsistency and subsequently flagging the at least one transaction inconsistency. The method may include monitoring a volume of entrant users in the raffle. The method may include monitoring separation of entrant user identification and account information. The method may include crosschecking the entrant user account information. The method may include verifying an authenticity of the entrant users' account information and denying access to a participant status when a comparison results in an improper result determination. The method may include denying access when triggering an improper result determination selected from the group consisting of a failed payment transaction; a denied payment transaction, and an insufficient funds transaction. The method may include monitoring a raffle payout log. The method may include archiving raffle payout and entrant user identification. The method may include establishing real-time raffle transaction analytics. The method may include validating a random winner selection. The method may include flagging a first-level provider administrative action on a remote processor.

In certain examples, the method includes logging modification transactions. The method may include logging modification transactions without deleting a first-level provider action. The method may include logging modification transactions without overwriting a first-level provider action. The method may include maintaining a first-level provider action catalog. The method may include maintaining a first-level provider action catalog independent of the administrator server. The method may include maintaining a first-level provider action catalog on two or more locations.

In particular examples, the method includes monitoring port access attempts. The method may include monitoring time-out logs. The method may include limiting a first-level provider log-in attempt. The method may include disabling inactive local machine functionality. The method may include disabling a hardware component of the local machine. The method may include disabling a software exchange component of the local machine.

In yet another embodiment of the disclosure, a multi-player donation raffle system comprises a network providing data communication to a plurality of mobile entrant user components independent of a physical geographical location; and an administrator server in data communication with the network and monitoring a first-level provider authorization access, wherein an authorization access enables input to the mobile entrant users for generating raffle transaction selections and creating events adapted to control at least in part the execution of a live-hosted donation raffle system.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
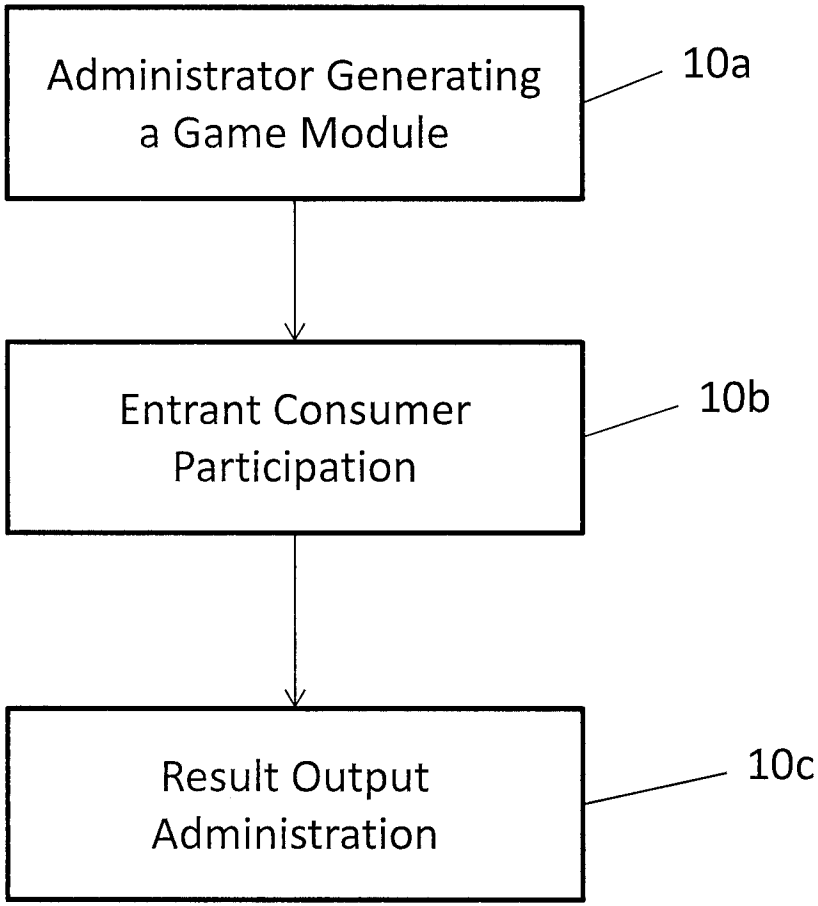
FIG. 1 is a system overview according to the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
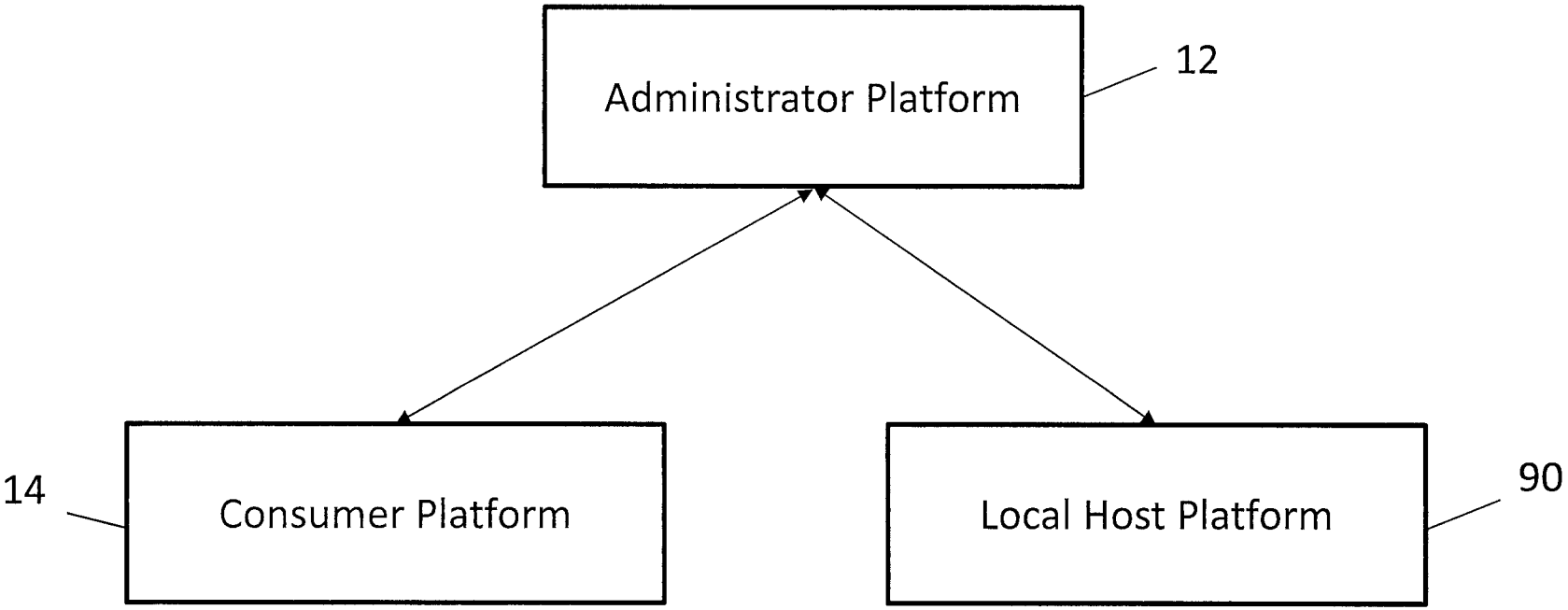
FIG. 2 is a schematic view of party platform interaction according to the present disclosure.
Figure 2A:
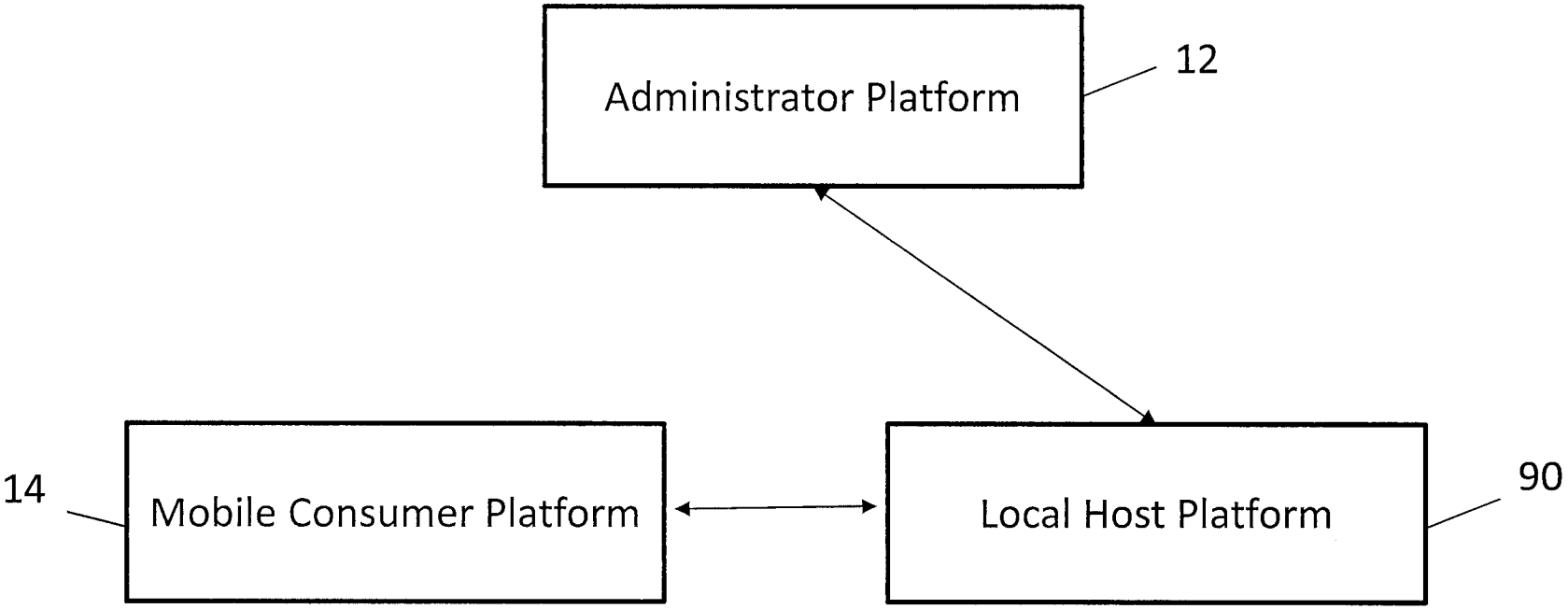
FIG. 2*a* is a schematic view of a particular interaction introduced in FIG. 2.

Referring now to the drawings in general and FIGS. 1 and 2 in particular, it will be understood that the illustrations are for the purpose of describing embodiments of the disclosure and are not intended to limit the disclosure or any invention thereto. As best seen in FIGS. 2*b*-5*b*, systems and assemblies are shown embodied according to the present disclosure to provide multiplayer raffle gaming experiences with an unanticipated level of administrative management control. In the embodiments and example herein, the end-users experience a synchronized secure raffle transaction, regardless of physical geographical location, including but not limited to sporting events and the like. As shown and described herein, embodiments include web-responsive usage available from any variety of server combinations, application usage available for download from any variety of server combinations or downloadable from an application provider, and any software combination thereof.

Figure 1A:
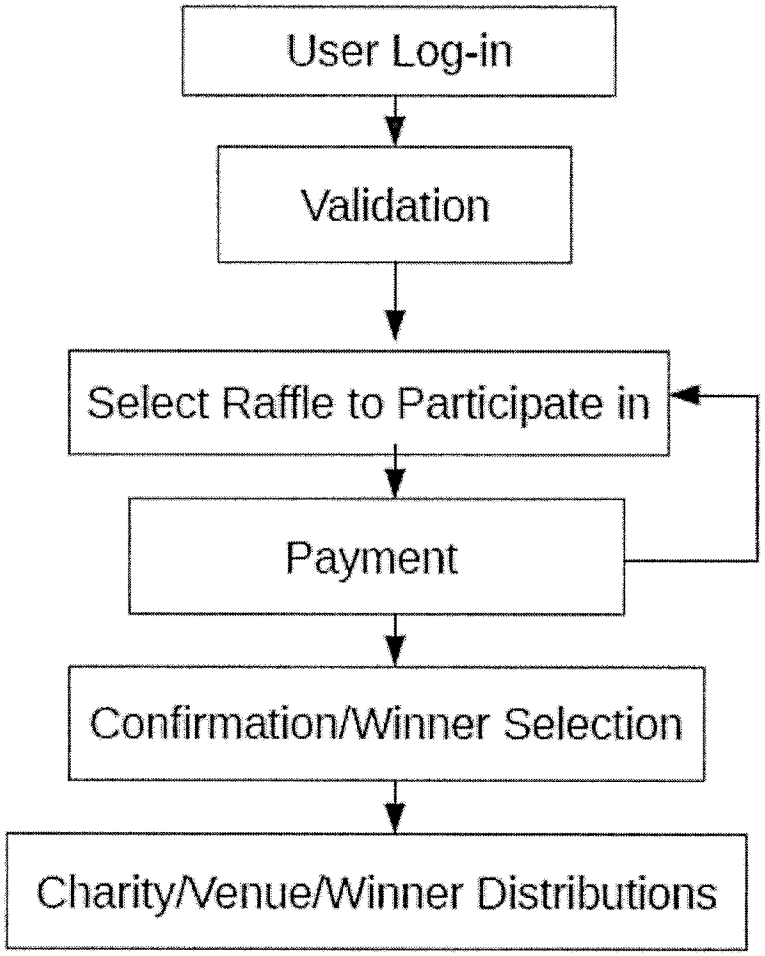
FIG. 1*a* is an overview flowchart of elements introduced in FIG. 1.

As best seen in FIGS. 1 and 1*a*, embodiments herein typically include one or more administrator network-connected server module(s) 10*a* coupled to multiple end user consumer participants 10*b* over a network, wherein the end users may interact through the network to generate a result output 10*c* from multiplayer secure transaction raffle system. Any of the software programing, end user application and coding, and administrator servers register, monitor, convey communications, and organize end user input. As shown and described herein, the end user software (or use of software specified by particular applications and programs) and the administrator servers have software programing to define game availability, instructions, happenings, and conclusions.

Figure 2B:
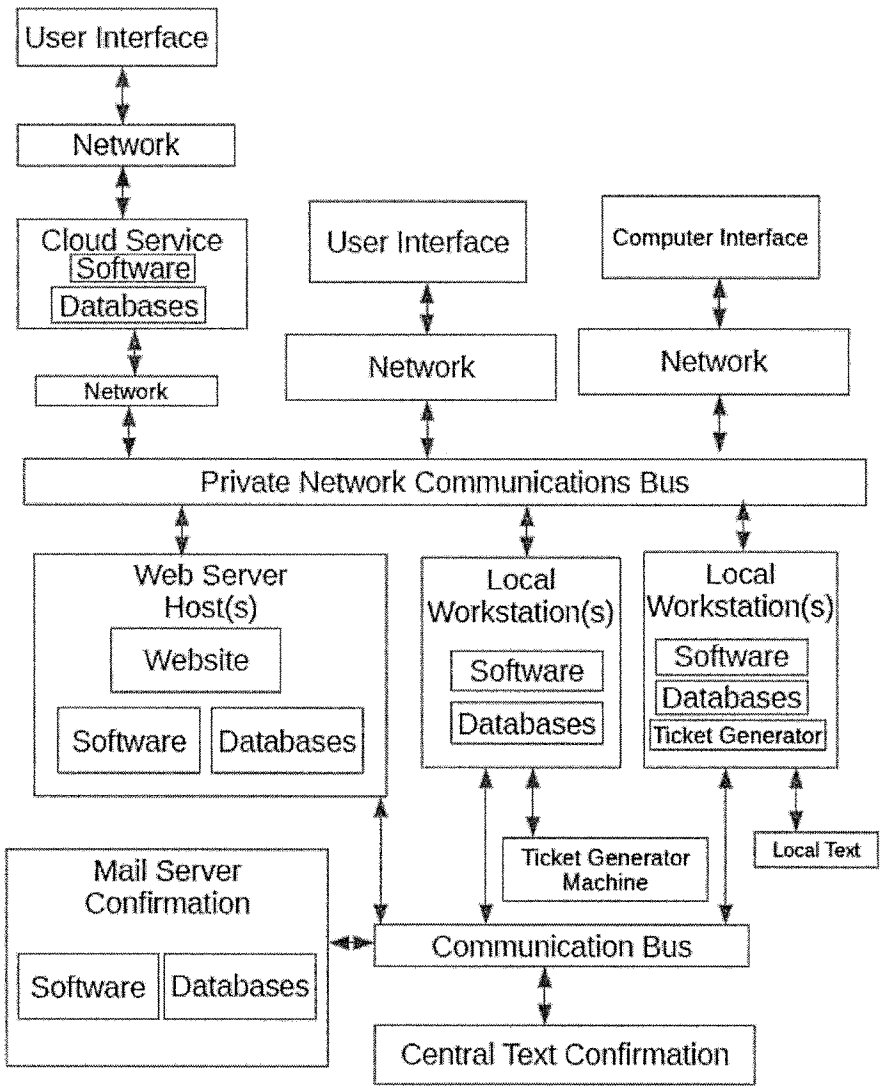
FIG. 2*b* is an overview flowchart of elements introduced in FIG. 2.

Generally, as shown in FIGS. 2-2*b*, the administrator platform 12 is a network-enabled system to execute a set of software application, for instance through a local host platform 90, to enable game organization and allow the consumer platform 14 to participate in a particular raffle game. Consumer entrant users 14 may be mobile entrant consumers and non-mobile entrant consumers. In particular examples, the entrant users 14 comprise network-enabled consumer electronic devices configured to execute a set of software application to enable two-way communications to participate in a particular game. In certain examples, the entrant user player 14 is a consumer electronic device with a display output, such as mobile phone, personal computer, personal digital assistant, video game consult, or the like. As shown and described herein, the entrant user device 14 may include at least a portion of software required to execute the systems and processes. While in other examples, software required to execute the systems and processes is stored in a persistent memory installed in a particular device. In still further examples shown and described herein, at least a portion of the software required to execute the systems and processes is accessed by the end user deice from the network and is downloaded as recognized by those skilled in the art having the benefit of this disclosure.

Figure 3:
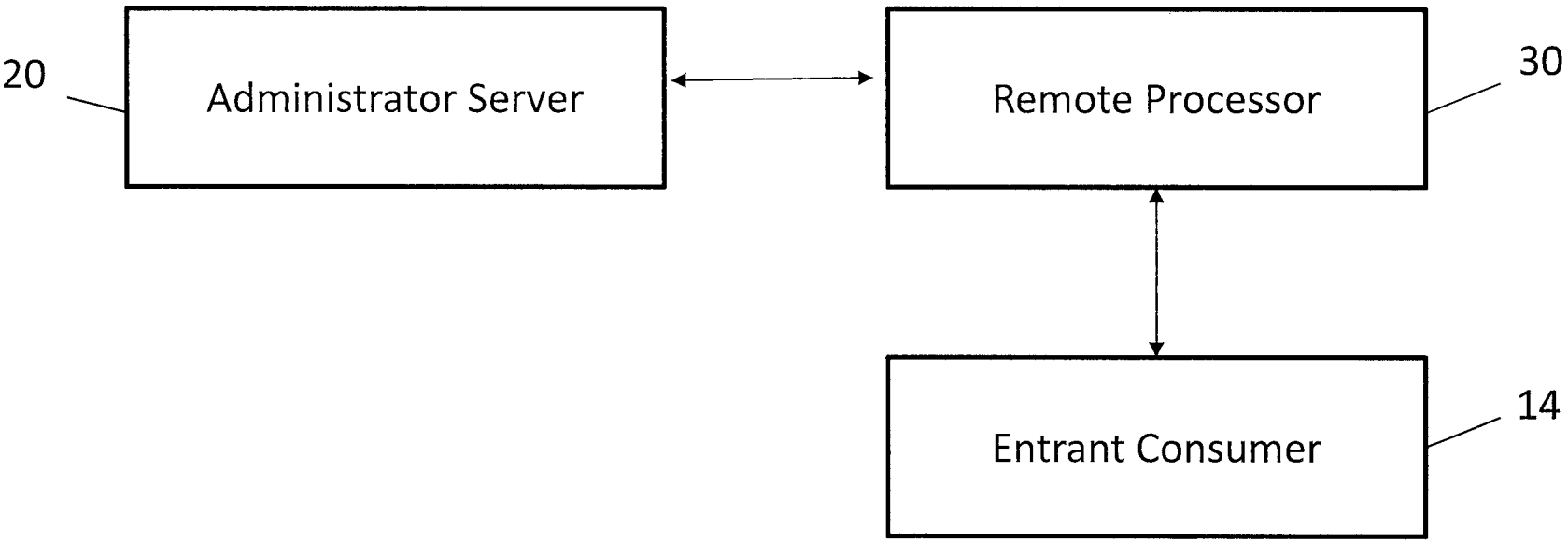
FIG. 3 is a schematic view of party platform interaction according to the present disclosure.
Figure 3A:
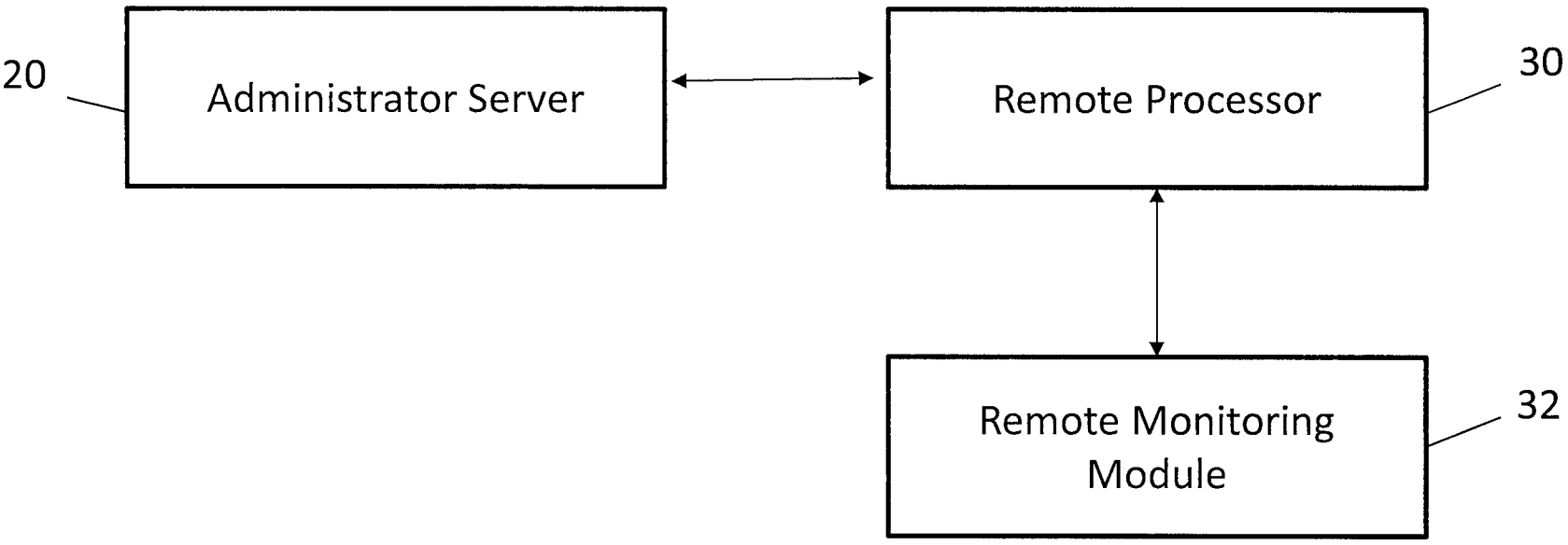
FIG. 3*a* is a schematic view of a particular interaction introduced in FIG. 3.

As introduced in FIGS. 3-3*a*, one embodiment of an administrator server 20 administers any of the secured automated raffle transactions shown and described herein. A remote processor 30 that is generally housed in a remote event location 90 communicates with the administrator server 20 and enable input to entrant consumers 14.

In certain examples, a remote processor minimizes system access according to a predefined privilege verification selection 42. For instance, the administrator server 20 has a multi-tiered administration access 44, i.e. a predetermined level of privilege access. For instance, the multi-tiered administration access 44 may include a full administrator privilege selection 46, for instance a full privilege administrator. In particular examples, a full administrator privilege selection 46 allows system wide changes, keep a document channel for upper administration to be able to do things like upgrade software, operating systems upgrade and routine maintenance, subsequent integrated module updates, and the like. Further, full administrator privilege selection 46 embodiments allow full access to completely create/delete anything on any of the system shown and described herein, including, but not limited to, making database formation adjustments. Applicants have unexpectantly discovered this full administrator privilege selection 46 is beneficial for releasing a lesser stable version with the ability to script, ssh login, cd/dvd mailed updates to the system, and the like.

In some embodiments, the multi-tiered administration access 44 includes a limited administrator privilege selection 48, for instance a less privileged administrator access than the full administrator privilege selection 46. In addition, the multi-tiered administration access 44 may include a remote log-in privilege 49. Still further, the multi-tiered administration access 44 may include a lesser privileged access for managing limited administrator roles, including a local remote administrator privilege 47. Still yet further, the multi-tiered administration access 44 may include a principal machine-level privilege 45. These partial privilege access rights are governed by the limited administer privileges 28, remote log-in privilege 49, local remote administrator privilege 47, a principal machine-level privilege 45, and the like administrator users shown and described herein.

The remote processor 30 typically includes a remote monitoring module 32. In particular embodiments, the administrator server 20 accesses the remote processor 30 through a remote processor entry point 36 to authenticate itself to the remote system, provide a persisted connection for a duration sufficient to complete all administration tasks, monitor communications route/protocol/policy to ensure that the predetermined user has sufficient privilege to accomplish any of the enumerated tasks remotely. In particular examples, the remote processor entry point 36 is a web browser entry point 40, such as a ssh login, a Firefox, chrome, or similar web browser based entry point 40 to the remote machine 30. Further, the remote monitoring module 32 may include a monitoring script 34 or the like as recognized by one of ordinary skill in the art having the benefit of this disclosure.

Figure 4:
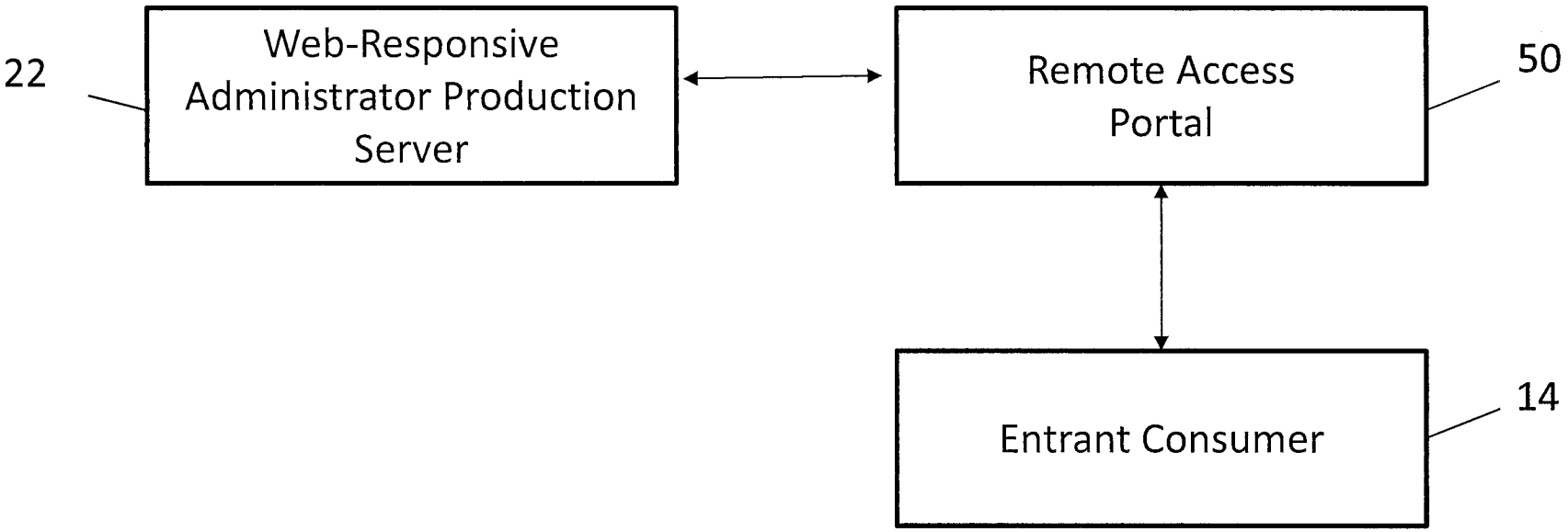
FIG. 4 is a schematic view of party platform interaction according to the present disclosure.
Figure 4A:
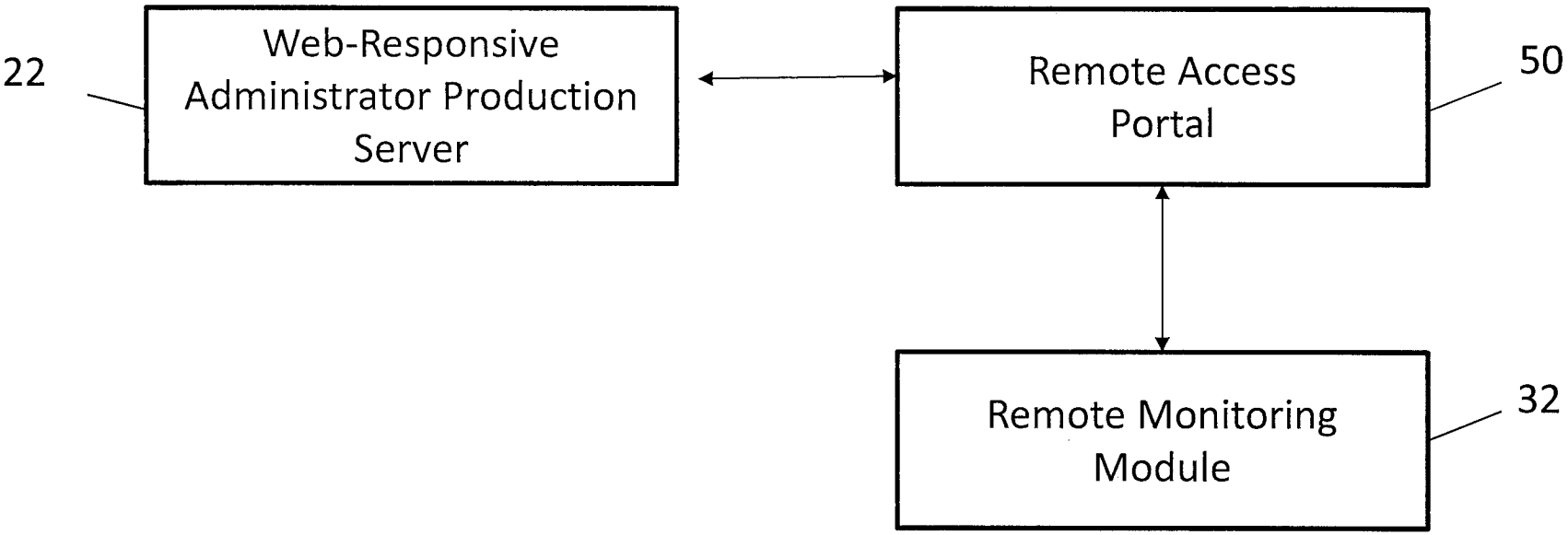
FIG. 4*a* is a schematic view of a particular interaction introduced in FIG. 4.

In yet another embodiment introduced in FIGS. 4 and 4*a*, a web-responsive administrator production server 22 administers any of the secured automated raffle transactions shown and described herein. A remote access portal 50 provides data exchange with the administrator production server 22 to enable input and output exchange with entrant consumers 14. Typically, the web-responsive administrator production server 22 communicates over a privileged static IP address 60.

In one example of the web-responsive administrator production server 22 set-up, the path to the housed files executing would be from the phone to the local ISP-Skyline-after dns resolution from GoDaddy® to the static IP address 60, for instance at a central administrator machine is housed. Thus in this example, the administer connects to the local remote machine, complete the necessary work, and then logs out.

Again, in some of these examples the multi-tiered administration access 44 includes a limited administrator privilege selection 48, for instance a less privileged administrator access than the full administrator privilege selection 46. In addition, the multi-tiered administration access 44 may include a remote log-in privilege 49. Still further, the multi-tiered administration access 44 may include a local remote administrator privilege 47. Still yet further, the multi-tiered administration access 44 may include a principal machine-level privilege 45, These partial privilege access rights are governed by the limited administer privileges 28, remote log-in privilege 49, local remote administrator privilege 47, a principal machine-level privilege 45, and the like administrator users shown and described herein.

Figure 5:
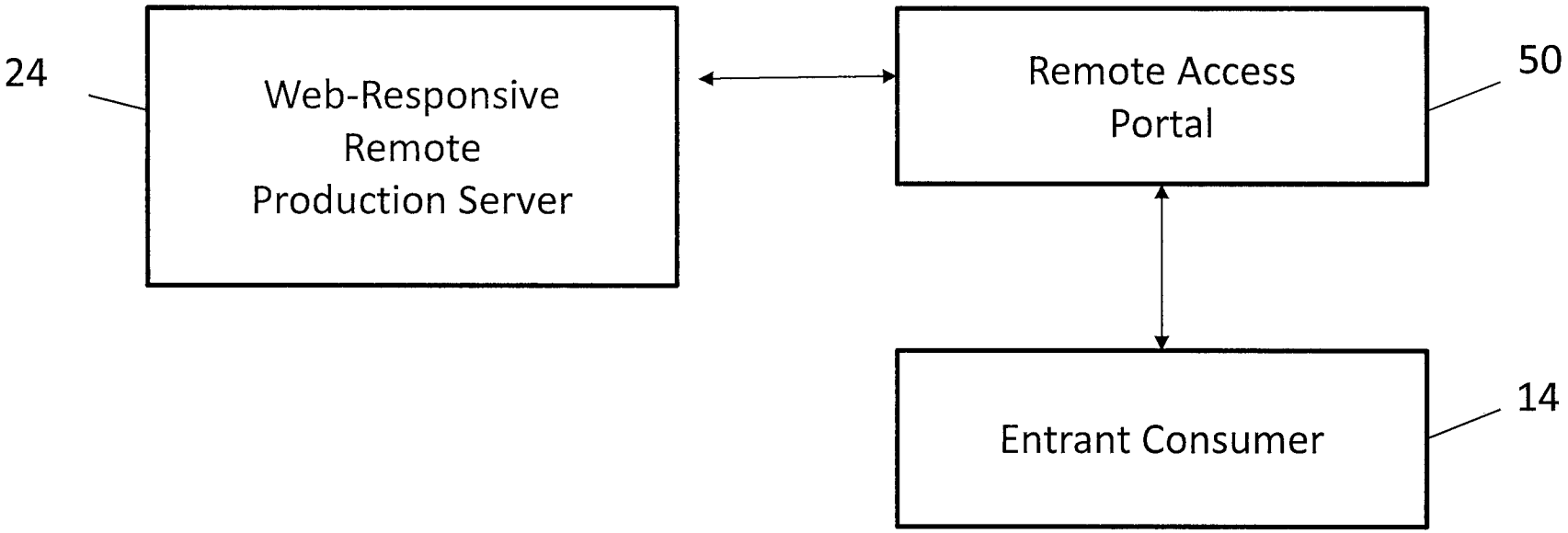
FIG. 5 is a schematic view of party platform interaction according to the present disclosure.
Figure 5A:
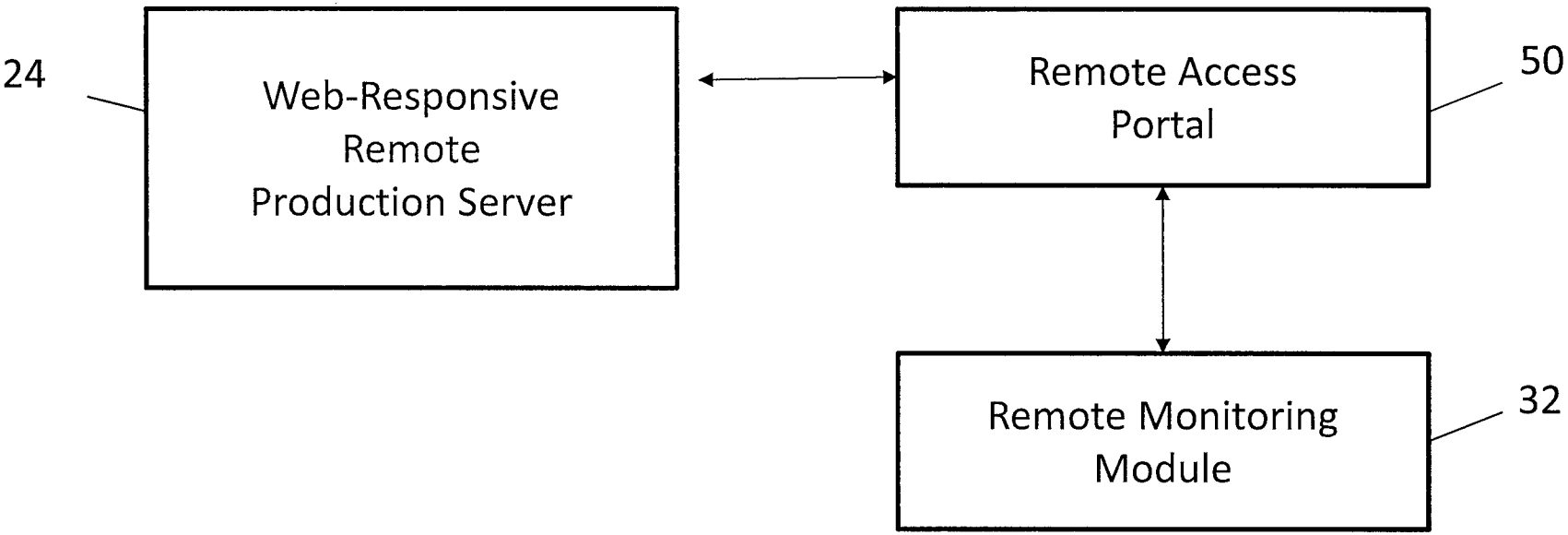
FIG. 5*a* is a schematic view of a particular interaction introduced in FIG. 5.

In an alternative embodiment illustrated in FIGS. 5 and 5*a*, a web-responsive remote production server 24 administers an entirely web-browser based software for any of the secured automated raffle transactions shown and described herein. A remote access portal 50 provides data exchange with the remote production server 24 and enable input and output exchange with entrant consumers 14. Typically, the remote production server 24 communicates over a privileged static IP address 60.

In one example of the remote production server 24 set-up, the administrator would log into the remote production machine 24, for instance directly bypassing an administrator machine. In these examples, configurations at this point can stay on that machine, or in the alternative, be sent up to the master production machine. In certain examples, this set-up may extend to any machine in any combination across the entire system.

Again, in some of these examples the multi-tiered administration access 44 includes a limited administrator privilege selection 48, for instance a less privileged administrator access than the full administrator privilege selection 46. In addition, the multi-tiered administration access 44 may include a remote log-in privilege 49. Still further, the multi-tiered administration access 44 may include a local remote administrator privilege 47. Still yet further, the multi-tiered administration access 44 may include a principal machine-level privilege 45. These partial privilege access rights are governed by the limited administer privileges 28, remote log-in privilege 49, local remote administrator privilege 47, a principal machine-level privilege 45, and the like administrator users shown and described herein.

Figure 6:
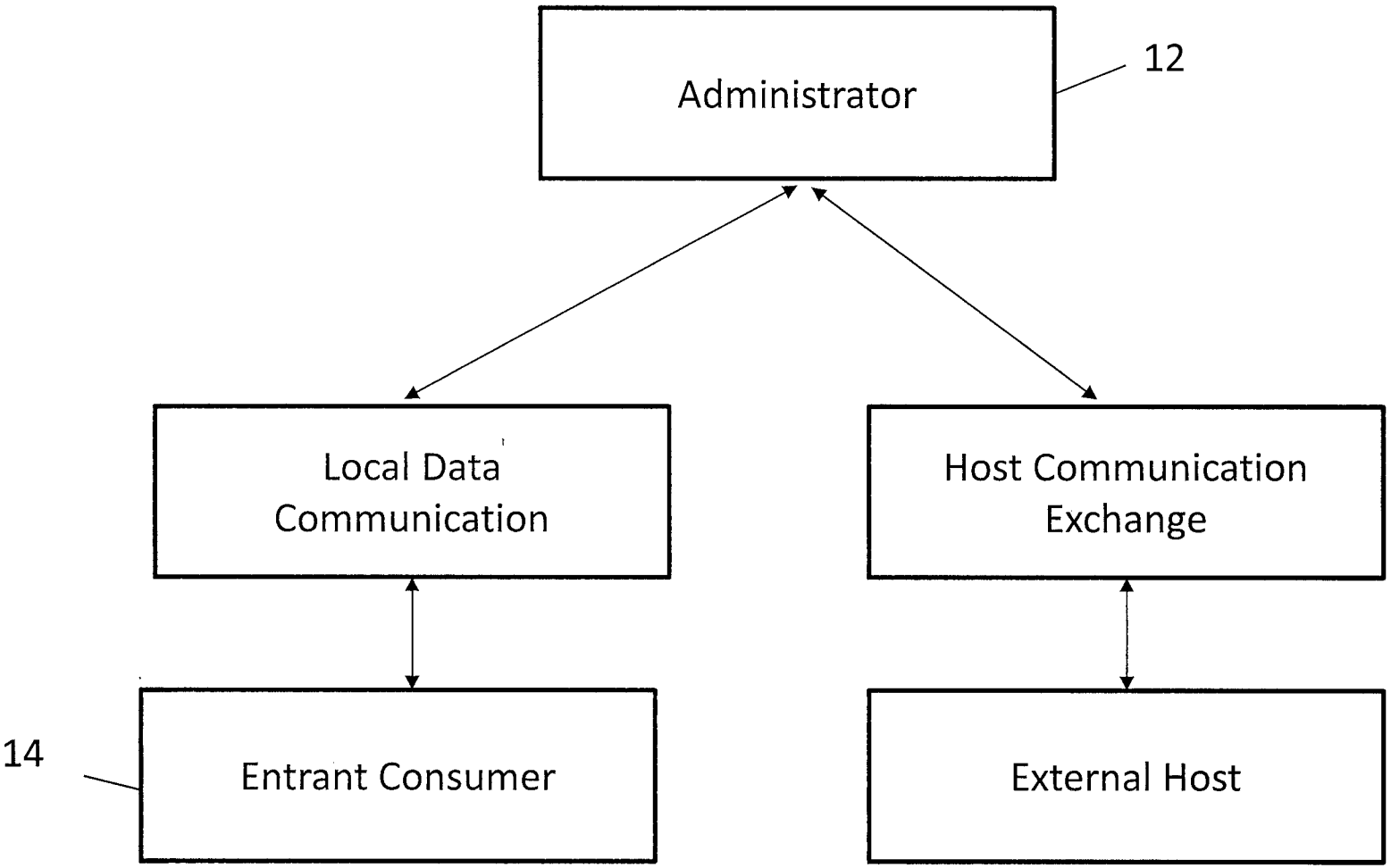
FIG. 6 is a flowchart of data communication examples introduced in the embodiment illustrated in FIG. 1.
Figure 6A:
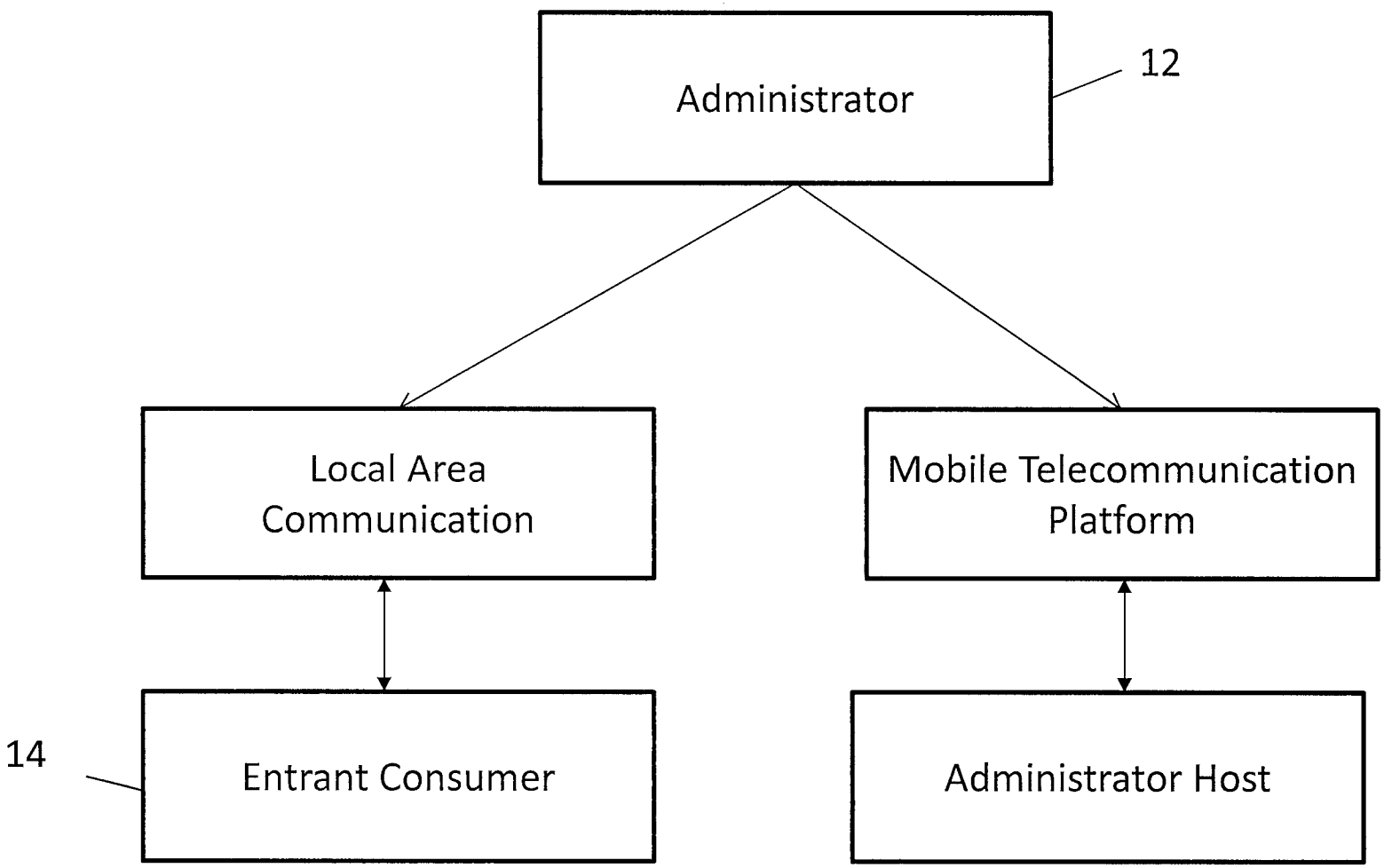
FIG. 6*a* is a flowchart of a particular communication introduced in FIG. 6.

Any of the network/internet embodiments and examples herein connecting the various elements may include any data communication platform as shown in FIGS. 6 and 6*a*, for instance wireless communications, mobile telecommunication platform, local area communication, physical connections, internetwork of networks, internet variations, WANA, metro-networks and the like and are not be limited to specific network connections.

Figure 7:
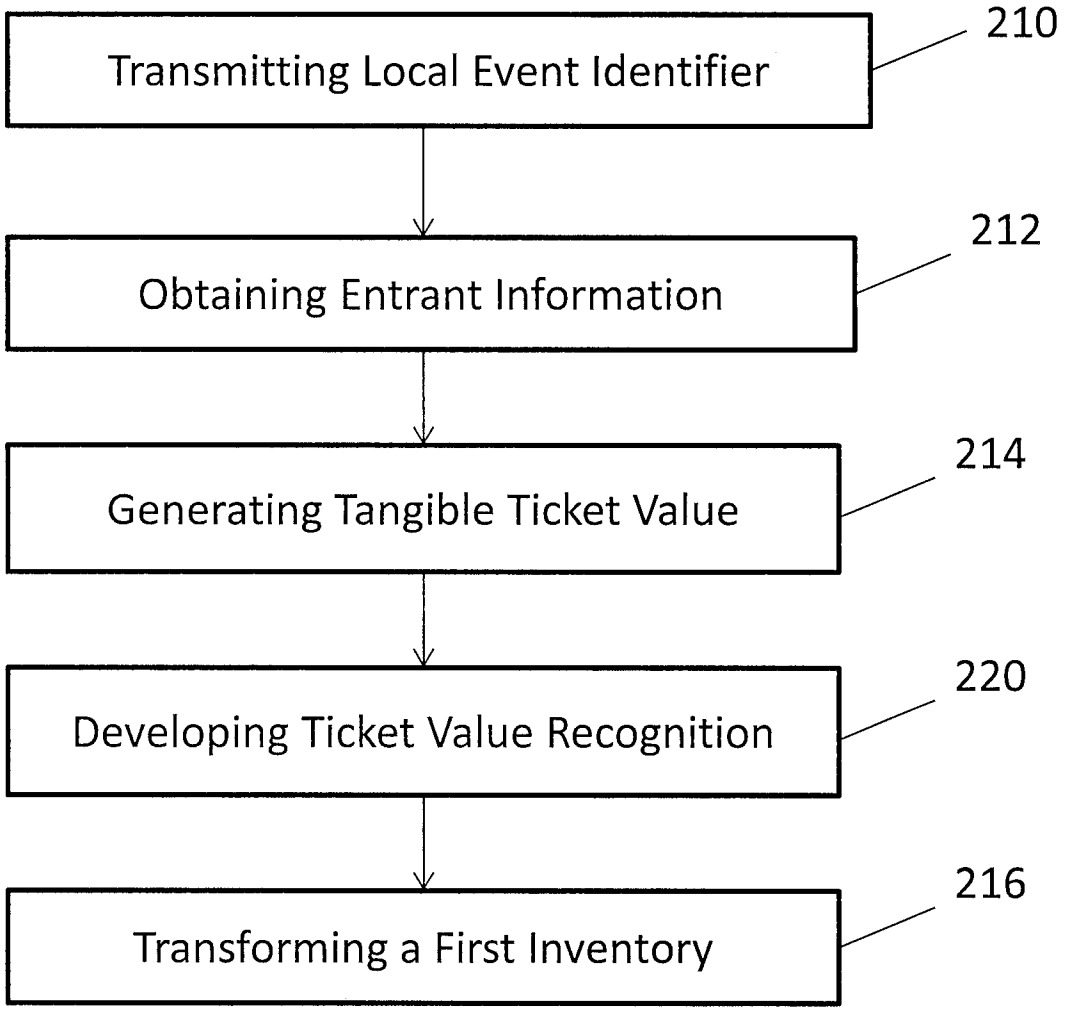
FIG. 7 is a flowchart of particular embodiments according to the present disclosure.
Figure 7A:
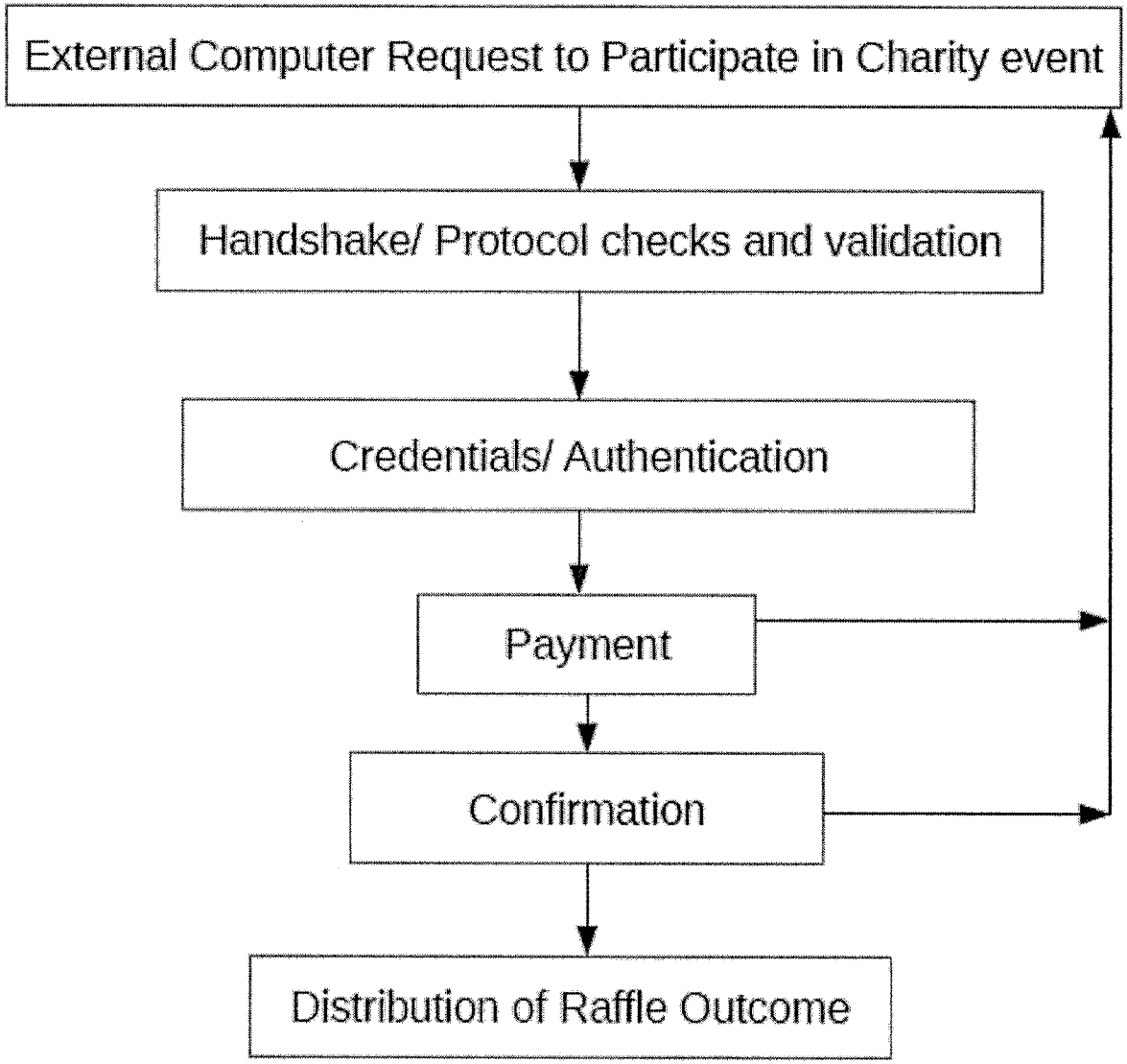
FIG. 7*a* is a flowchart of a particular example introduced in FIG. 7.
Figure 8:
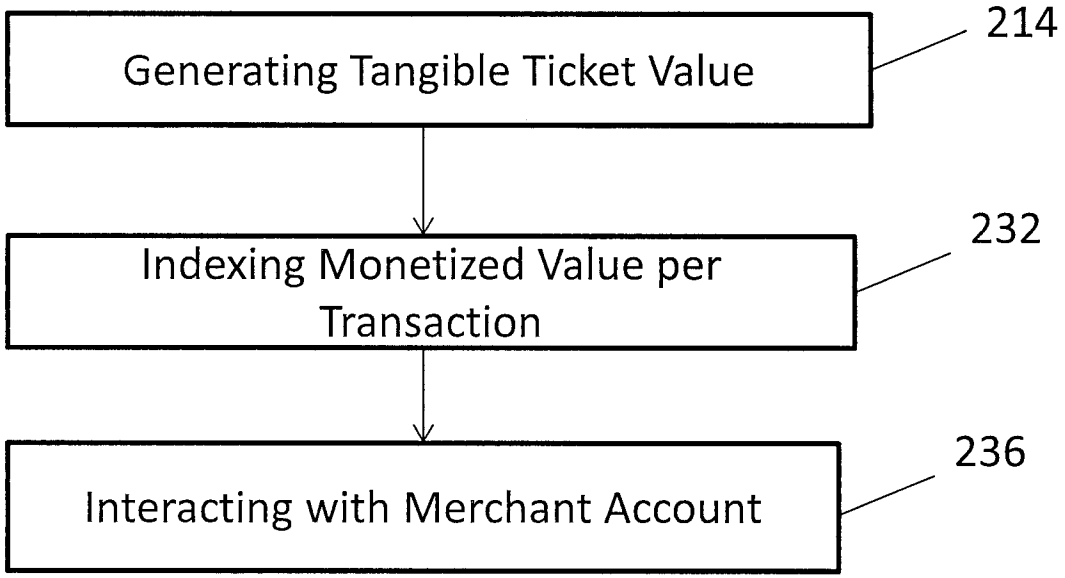
FIG. 8 is a flowchart of a particular example introduced in FIG. 7.
Figure 9:
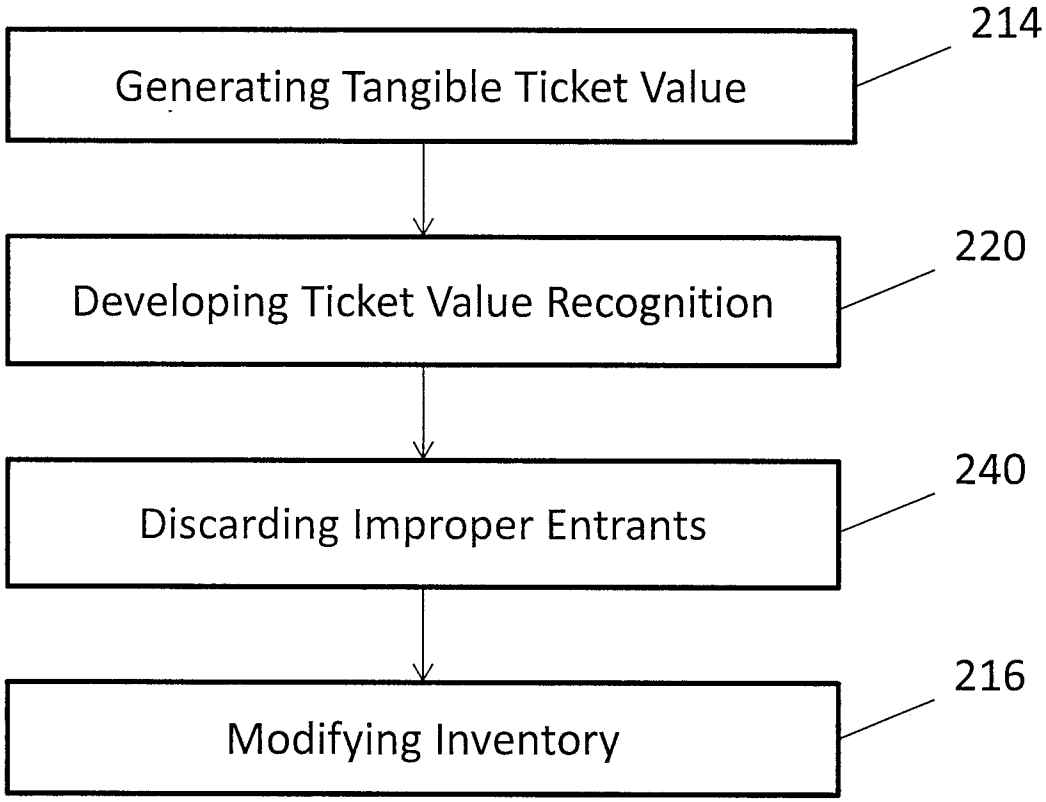
FIG. 9 is a flowchart of a particular example introduced in FIG. 8.
Figure 10:
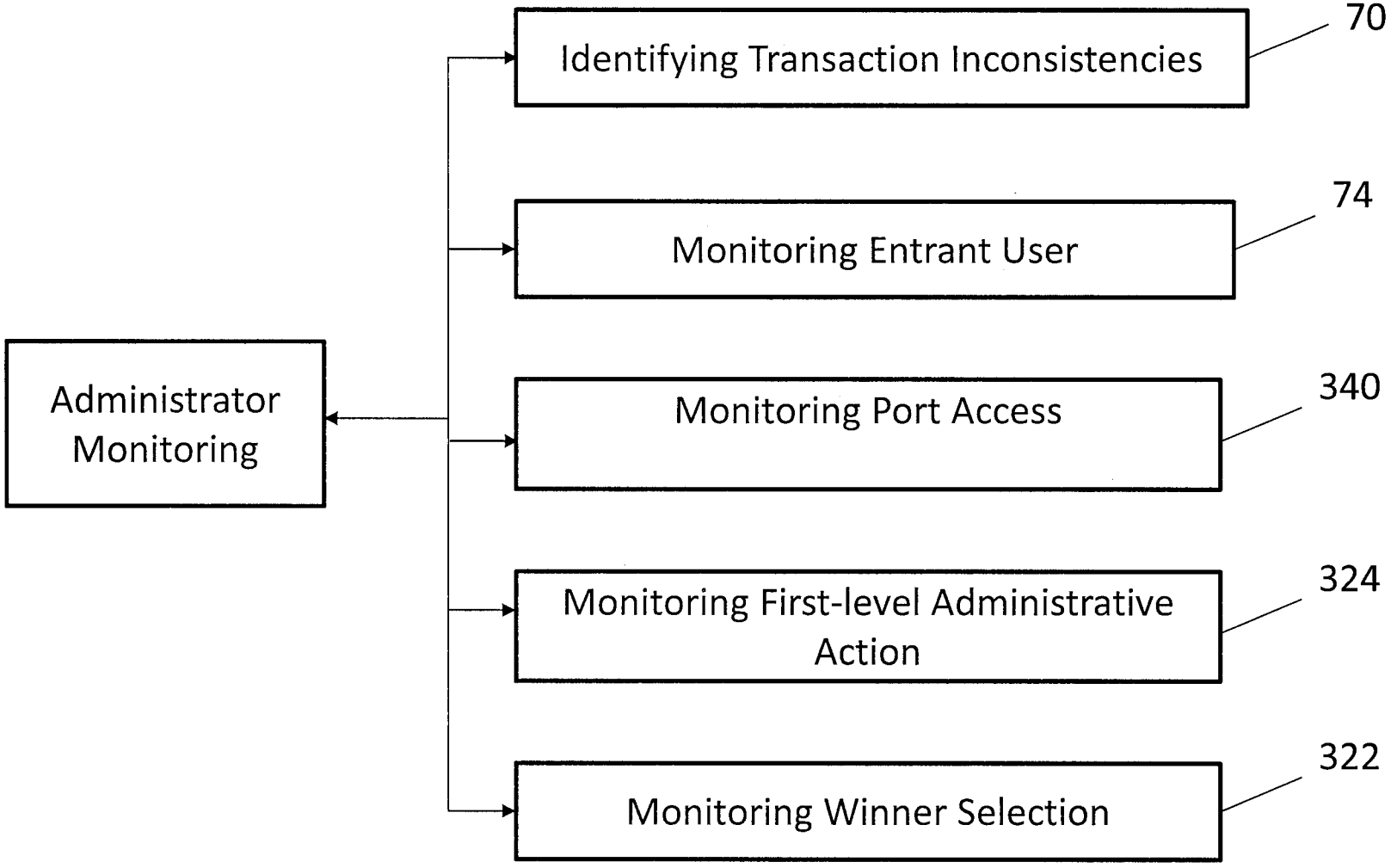
FIG. 10 is a schematic view of administer monitoring modules according to the present disclosure.

FIG. 7 introduces one embodiment of conducting any of the secured raffle transactions herein. Typically, the system transmits 210 a local event identifier. The system then receives 212 consumer entrant information. The system then generates a tangible ticket value 214. In certain examples the tangible ticket value is immediately delivered to the consumer entrant 14 in any of the delivery embodiments shown and described herein. The system then compares the mobile entrant information with administrator management for developing 220 a participant ticket value recognition. The plurality of participant ticket value recognition transactions are subsequently transformed 216 into a first inventory 250, and ultimately a winner selection is chosen from the first inventory 250.

Administrator management systems shown and described herein generate one raffle game, or a plurality of raffle games, typically associated with a local event, including, but not limited to, sporting events, festivals, social gatherings, and the like. In certain examples, the management system may host two or more raffle games from a particular local event. As shown in FIG. 7, the system transmits 210 a local event identifier, for instance an available, active raffle game. The identifier may include a narrative, advertisement, application link, website link, and the like.

Typically once the administrator system opens an active, available raffle event, a consumer entrant, including but not limited to a mobile user at a physical remote location, may trigger an entry by communicating an entry query, request, application, or the like. Those skilled in the art having the benefit of this disclosure will recognize a variety of methods and procedures to obtain 212 consumer entrant information. In certain examples, the consumer entrant information 52 may be a local event identifier selection 50, an entrant financial transaction contribution 54, an entrant identification verification 56, or similar consumer entrant input. Other examples include verifying authenticity 238 of the user entrant identity.

As shown in FIG. 7, in one embodiment after obtaining 212 consumer entrant information, a tangible ticket value, as compared to a mere confirmation code, is generated 214 and delivered to the consumer entrant for immediate recognition of the entrant information, for instance immediately following a click to buy confirmation shown and described herein. In certain examples, generating a tangible ticket value 214 includes indexing a monetized value per transaction 232. In this way a checkout can be tracked with the ticket values supplied. Further, the monetized value transaction may be tracked 234 to provide real-time valuation of the monetized value.

In certain examples, after generating a tangible ticket value 214, the system may interact 236 with a merchant account 500, for instance through a secured transaction confirmation, for instance interacting with at least one merchant account 500 includes receiving authorized financial approval from a third party payment center 502.

The tangible ticket value 214 is typically dynamic and impacted by any of the financial transaction determinations and entry inputs herein. In certain examples, the system may discard 240, i.e. remove from an active listing prior to the winning selection, for instance from the first inventory described herein; following any type of improper user entrant transaction 242, for instance a failed payment transaction 85 a denied payment transaction 86, an insufficient funds transaction 86, and the like. In certain examples, generating a tangible ticket value 214 follows receiving an acceptance confirmation 244 from the entrant and/or financial institution. Generating a tangible ticket value 215 may follow receiving a purchase agreement confirmation 246 from the entrant and/or financial institution. Any of the tangible ticket value shown and described herein may be presented to the entrant user in a variety of orientations and displays. In certain examples, delivery of the tangible ticket value may include serving 248 a revocation caveat disclaimer 249, for instance a failed payment transaction disclaimer, a denied payment transaction disclaimer, an insufficient funds transaction disclaimer, and any similar disclaimer.

In particular examples, the accrued value of a particular raffle game event is parsed into multiple components. For instance, the venue claims stake to a portion, the winner claims stake to a portion, the charity organization claims stake to a portion, and the system has a portion reserved for processing payments for usage of the services. The venue that the original physical account is holding funds to be dispersed will be able to verify a valid winner, have the winnings deducted from their physical and virtual account to pay the winner, and transfer the remaining funds for the charity of the particular raffle. In certain examples, a financial portion reserved will pay for transaction processing fees prior to the venue clearing as described herein to provide that the venue account is not deducted more than a particular coast value for providing the particular raffle event.

A winning selection for any of the raffle games herein may be generated by any procedure of transforming the active inventory to a random winner selection(s). In one example, a winner selection includes developing an array 264 of the inventory, including but not limited to a first inventory or modified subsequent inventory modified by any of the procedures herein. For instance, transforming the array of first inventory with at least one module operator 266 and generating the random winner selection as recognized by those skilled in the art having the benefit of this disclosure.

In one particular example, a raffle game will comprise an opening event/timing and a closing event/timing for entrant user participation. In certain examples, the system will house a quasi-account that mimics actual financial accounting handling appropriation of funds. In this way, these particular examples do not house, i.e. receive, retain, or disclose, sensitive entrant user information, for instance including, but not limited to, credit card material. Instead, the system will merely act as a trigger to have physical payout by the venue. Further, in particular examples, generating 260 a random winning code **320*a* includes transmitting 262 the winning code 320*a*** to a local administrator communication device.

In particular examples, the system a request 280 for querying a winner selection. The procedure may isolate 270 at least one expired raffle 350, isolate at least one unpaid winner selection 352, and the like. Typically the administrator management module confirms, or denies, 354 available funds to fund the at least one unpaid winner selection. The method may include validating a net transaction determination 272. The method may include verifying an administrator validation input 274. The method may include generating a net transaction display 276. The method may include generating a net transaction log 278. Further, the method may include validating the winner selection determination 280. The method may include verifying an administrator validation input 282. The method may include generating a winner selection display. The method may, include generating 284 a winner selection log 286. The method may include issuing 288 a payment check 290, for instance a hard copied check or the like, corresponding to the winner selection, and in particular examples, link 292 the check to a winner selection account or other entrant user associated connection. The method may also include issuing a tax statement report 294. The method may include delivering a full donation option selection 296 to an initial entrant user, entrant user with the winning selection, or the like, for instance allowing direct donation and bypassing any of the payment and winner selection modifications shown and described herein.

Administrator modules monitor any of the procedures and elements herein, including website usage and non-web browser driven software systems, and to make appropriate modifications to the system. The administrator modules may overlap to manage a plurality of organizations utilizing the processes and systems herein.

Administrator modules may be limited by any of the administrator privilege categories shown and described herein. In one example, local administration modules may administer various aspects, including, but not limited to, add an image to the lobby-customized screen for their venue, add users to the system and create additional local administrators, modify users on the system with limited privileges, modify host organizations for instance adding or removing organizations from a main screen selection list create charity organizations/donation recipient(s), create raffle event(s), manually initiate a particular raffle game event, manually terminate a raffle game event, add ticket roll numbers to a particular raffle game event, winner selection and payment modules shown and described herein, generate reports and tax information shown and described herein, and log service and application system concerns.

Particular modules monitor database inconsistencies and possible fraudulent activities, both at the local level and for potential unauthorized usage. For instance, administrator modules may identify at least one transaction inconsistency 70 and subsequently flag 72 the transaction inconsistency 70. Certain inconsistencies 70 may include, but are not limited thereto, a number of transactions per raffle, current status of any given transaction, transaction data per user and payment verifications, physical separation of transactions and account information, detailed account data, integrity of active users on the system, transaction and account cross-checking, data redundancy, payout history and procedure from the purchaser's administration, archived raffles game events, backup procedures and offloading of archived data, real time access to each event's dollar amount generated totals, separation of transaction processing stages to verify proper channels of updates.

Further, administrator modules may monitor a volume 74 of entrant users in the raffle to update and modify the tangible ticket values, inventories, and the like. In certain examples, administrator modules may monitor proper security separation 76 of entrant user identification 300 and any of the corresponding account information 302 shown and described herein. In certain examples, administrator modules may crosscheck 78 the entrant user account information.

In certain examples, administrator modules may verify an authenticity 310 of the entrant users' account information and, in particular examples, denying access 82 to a participant status when a comparison results in an improper result determination 84. Access may be denied when a failed payment transaction 85, a denied payment transaction 86, and an insufficient funds transaction 87.

In certain examples, administrator modules may monitor 92 a raffle payout log 94, including logs of active, concluding, and expired raffle events. In particular examples, administrator modules archive any of the 96 raffle payout 320 and entrant user identification 200 shown and described herein. The method may include establishing real-time raffle transaction analytics, including but not limited to, statistical analyzation tools like histograms and density plots of activity for the single user, the group of users per event, and time frames of ongoing activity. For instance, the administrator modules may monitor 92 accompanying data for each participant-log IP addresses for each transaction, log how many tickets purchased per transaction, log verification from a third party payment for the participant to the system, and the like.

In certain examples, administrator modules may flag 324 a first-level provider administrative action, including any of the local or intermediate administrator user privileges herein to provide proper monitoring with unexpected minimal development time for patches once a system is in operation. For instance, administrator modules may log 326 modification transactions, and in certain examples, without deleting a first-level provider action and without overwriting a first-level provider action. The method may include maintaining a first-level provider action catalog 328. The method may include maintaining 330 a first-level provider action catalog independent of the administrator server. In certain examples, first-level provider action is maintained in a catalog on two or more locations.

In certain examples, administrator modules may monitor port access attempts 340, for instance to thwart unwanted access. Similarly, administrator modules may monitor time-out logs 342. Further, administrator modules may limit 364 a first-level provider log-in attempt, disable inactive local machine functionality, disable a hardware component 351 of the local machine, and disable a software exchange component 353 of the local machine to help remedy brute force attack from administration and external environment.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A method of generating a secure administrator-implemented transaction, said method comprising:

a. transmitting at least one local event identifier from an administrator management system;

b. obtaining a user entrant information independent of a physical geographical location and selected from a group consisting of a local event identifier selection, an entrant financial transaction contribution, and an entrant identification verification;

c. interacting with at least one merchant account corresponding to said user entrant, including receiving authorized financial approval from a third party payment center;

d. generating a tangible ticket value and delivering a tangible ticket value notification to said user entrant;

e. developing a participant ticket value recognition from said user entrant information;

f. identifying at least one transaction inconsistency, when available, and subsequently flagging said at least one transaction inconsistency;

g. transforming a plurality of participant ticket value recognition transactions into a first inventory, generating a random winning code and transmitting said random winning code to a local administrator communication device, establishing a request for querying a winner selection, selecting a winner selection from said first inventory, and confirming available funds to fund at least one unpaid winner selection;

h. validating a winner selection determination; and i. monitoring a raffle payout log.

2. The method of claim 1, wherein generating said tangible ticket value includes producing an index of monetized values per transaction.

3. The method of claim 2, including tracking a monetized value transactions.

4. The method of claim 1, including verifying authenticity of a mobile entrant identity.

5. The method of claim 1, including discarding an improper user entrant transaction.

6. The method of claim 5, wherein said improper entrant transaction includes a determination selected from the group consisting of a failed payment transaction, a denied payment transaction, and an insufficient funds transaction.

7. The method of claim 1, wherein generating said tangible ticket value follows receiving an acceptance confirmation.

8. The method of claim 1, wherein generating said tangible ticket value follows receiving a purchase agreement confirmation.

9. The method of claim 1, including confirming available funds to fund at least one unpaid winner selection.

10. The method of claim 1, including validating a net transaction determination consisting essentially of verifying an administrator validation input, generating a net transaction display, and generating a net transaction log.

* * * * *